US005293719A

United States Patent [19]

Sugda

[11] Patent Number: 5,293,719

[45] Date of Patent: Mar. 15, 1994

[54] SEWER CHIMNEY COUPLING

[76] Inventor: Peter J. Sugda, 68 Sanrico Dr., Manchester, Conn. 06040

[21] Appl. No.: 2,715

[22] Filed: Jan. 11, 1993

Related U.S. Application Data

[62] Division of Ser. No. 789,922, Nov. 19, 1991, Pat. No. 5,189,861.

[51] Int. Cl.[5] ..... 52 745.03; E02D 27/14

[52] U.S. Cl. ..... 52/21

[58] Field of Search ..... 52/741.1, 741.4, 745.2, 52/745.3, 745.9, 747, 20, 19, 21; 264/31, 32, 34, 35

[56] References Cited

U.S. PATENT DOCUMENTS

| | | | |
|---|---|---|---|
| 1,712,510 | 5/1929 | Monie . | |
| 3,562,969 | 2/1971 | Little, Jr. | 52/20 |
| 3,621,623 | 11/1971 | Downes | 52/20 X |
| 3,745,738 | 7/1973 | Singer . | |
| 4,127,990 | 12/1978 | Morrow . | |
| 4,253,282 | 3/1981 | Swartz | 52/20 |
| 4,333,580 | 6/1982 | Sweigert, Jr. | 52/20 X |
| 5,040,351 | 8/1991 | Cornwall | 52/741.1 |
| 5,054,956 | 10/1991 | Huang | 52/20 X |
| 5,168,862 | 12/1992 | McGee | 52/741.1 X |
| 5,189,861 | 3/1993 | Sugda . | |

FOREIGN PATENT DOCUMENTS

| | | | |
|---|---|---|---|
| 0101935 | 6/1983 | Japan | 52/20 |
| 0024728 | 2/1986 | Japan | 52/20 |

*Primary Examiner*—Carl D. Friedman
*Assistant Examiner*—Lan M. Mai
*Attorney, Agent, or Firm*—Blodgett & Blodgett

[57] ABSTRACT

A sewer chimney and method of forming a sewer chimney for connecting a surface branch sewer pipe to a deeply buried main sewer pipe having a fixture with an upwardly facing opening. The chimney is constructed of a plurality of precast concrete elements including a supporting base adjacent the main sewer pipe, one or more transitional sections on the supporting base and a cap block which rests on the upper most transitional section. An elongated vertical pipe extends from the fixture of the main sewer pipe to the cap block. Seals are provided between each of the concrete precast sections and seals are provided between the elongated vertical pipe and components of the construction.

10 Claims, 12 Drawing Sheets

Fig.1
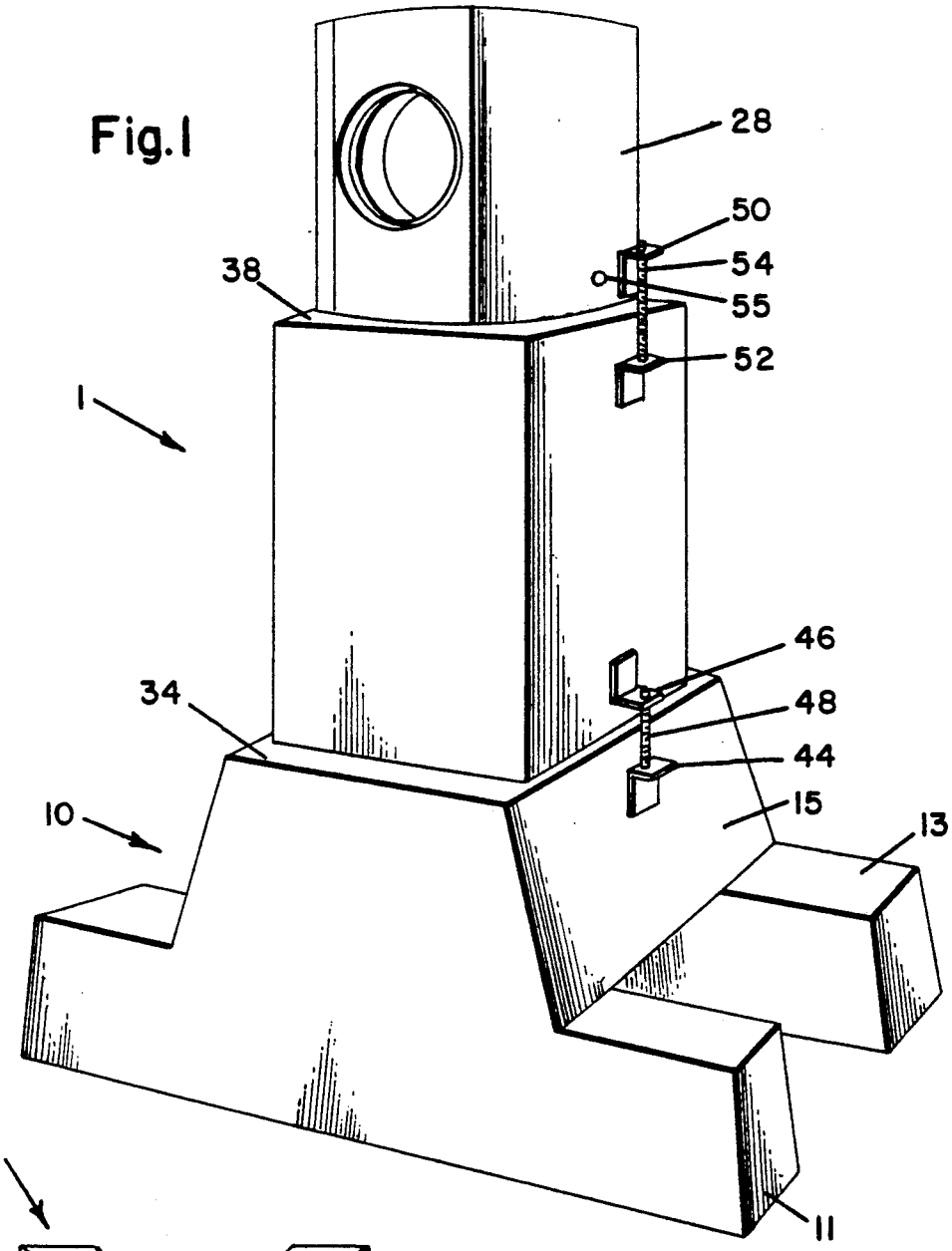
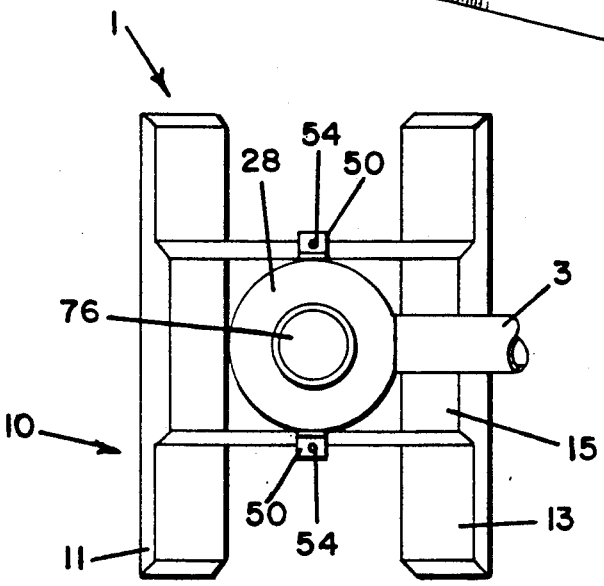
Fig.2

72
74
76
58
56
28
30
32
62
66
64
70
68
3
32
78
80
60
82

72
76
58
74
56
28
30
32
66
62
64
70
86
88
84
32
80
78
60
82

SEWER CHIMNEY COUPLING

This is a divisional of copending application Ser. No. 07/789,922 filed on Nov. 12, 1991 now U.S. Pat. No. 5,189,861.

BACKGROUND OF THE INVENTION

The present invention relates to the installation of sewer systems and the like. The invention is particularly directed to a sewer system structure known as a "sewer chimney" which joins a lower sewer main line to an upper sewer branch line. A sewer chimney is usually constructed as an appurtenance to a deep sewer to allow the branch line (building connections or lateral branch lines) to be installed at a shallower depth. These chimneys vary in height and in pipe size, but are typically used for a residence or small commercial building.

Concrete chimneys are typically built by pouring a concrete mix into a form on the job site. This technique produces defective sewer chimney structures as a result of incomplete drying, cracking and overload conditions on the mainline sewer unfavorable weather conditions; many of the problems which are associated with pouring concrete into a form can be avoided by prefabricating the sewer chimneys before they reach the construction site. The prefabricated sewer chimney includes several parts which are assembled at the construction site.

A common problem with such prefabricated concrete sewer chimneys is that parts may not seal properly due to voids in concrete or may vary in the sealing surface being irregular so as to prevent proper construction of the chimney. If the parts do not fit together perfectly, it is difficult or impossible to maintain water-tight seals between the parts.

In the prefab sewer chimney systems which are in current use, a short pipe or nipple extends upwardly from the main line fixture to a fixture in the bridge portion of the supporting base. There is a seal between the main line fixture and the bottom of the nipple, and a seal between the nipple and the bridge portion of the base. The seal in the bridge portion is a gasket which surrounds the upper end of the nipple and which permits relative movement between the nipple and the supporting base while maintaining a water-tight seal between the bridge portion of the base and the nipple. This is an important feature for ease of installation and for allowing for settling of the chimney structure after installation. The cap block at the top of the sewer structure has a built-in T-fixture. The T-fixture and the cap block includes a vertical bore which is vertically aligned with the nipple and the horizontal bore for receiving a service pipe. A captured seal unit is provided between each concrete structure of the chimney so that the system is water-tight from the "T" in the cap block to the main line fixture.

There are two problems which are associated with the nipple which extends from the main line fixture. If the nipple is too long relative to the seal in the bridge portion of the supporting base, there is always a standing volume of sewerage above the seal. Also, if the nipple is cut too long, the top of the nipple may impinge upon the riser section just above the bridge portion of the base, thereby putting pressure on the main line "T" or even structural failure of the mainline tee. This results in a leak at some point in the structure. Even if the riser does not impinge upon the riser section just above the bridge portion during installation of the chimney unit, subsequent settling of the chimney unit may cause the nipple to impinge upon the riser which is located just above the bridge portion creating problems as previously mentioned. If the nipple is too short, the nipple may not extend above the seal in the bridge portion which results in a leak.

There are many other factors which contribute to the failure of present day prefabricated sewer chimneys to maintain a water-tight seal. Although the prefabricated sewer chimneys include seals between each precast concrete section, the seals are often broken or damaged through carelessness of the workers during assembly, failure due to workers using the wrong size seal, or by the units being struck by boulders during the backfilling operation. Damage to these seals can also occur if the sewer chimney is struck by equipment during the installation of service laterals to the building which is being serviced. The placing of too much backfill on one side of the unit causes uneven stresses in the sewer chimney which can also result in damage to the seals. In many cases, the damage to the seals occurs during subsequent service work long after the initial installation of the unit.

Another problem which is associated with existing sewer chimney systems concerns the need to accommodate different types of service pipes. The service pipe specifications vary considerably from one locale to another and for each type of service installation. For example, two commonly used service pipes differ in wall thickness and in outside diameter so that a different block "T" must be used for each type of service pipe used. These and other difficulties experienced with the prior art devices have been obviated in novel manner by the present invention.

It is, therefore, a principal object of the invention to provide a precast sewer chimney which is substantially more resistant to loss of water-tight integrity than existing sewer chimney structures.

Another object of this invention is the provision of a precast sewer chimney which has the ability to accept service pipes of different diameters.

A further object of the present invention is the provision of a precast sewer chimney which can be effectively tested for water-tight integrity in or out of the unit during and immediately after installation of the structure.

It is another object of the present invention to provide a precast sewer chimney which can be effectively tested for water-tight integrity wherein if a leak does occur, it will be pinpointed for repair of the seal at that point.

A still further object of the invention is a provision of a precast sewer chimney structure which can be tested and put into immediate use during construction of the structure thereby eliminating by-pass pumping.

It is a further object of the invention to provide a precast sewer chimney structure which has inner and outer sealing systems thereby greatly increasing the chances that the sewer chimney will maintain its water-tight integrity.

It is a further object of the invention to provide a precast sewer chimney structure which allows for settling of the chimney structure without losing its sealing effectiveness.

It is a further object of the invention to provide a method of installing a precast sewer chimney structure which can be installed easily, quickly and safely.

It is a still further object of the invention to provide a method of installing a precast sewer chimney structure which insures water-tight integrity of the structure.

With these and other objects in view, as will be apparent to those skilled in the art, the invention resides in the combination of parts set forth in the specification and covered by the claims appended hereto.

SUMMARY OF THE INVENTION

The invention consists of a sewer chimney for connecting a surface branch sewer pipe to a deeply buried main sewer pipe having a fixture with an upwardly facing opening. The sewer chimney is made up of a plurality of precast sections including a supporting base, one or more transitional sections which rest on the base and a cap block which rests on the uppermost transitional section. Each section has a vertical bore which is vertically aligned with the upwardly facing opening of the main sewer pipe fixture. The cap block, in addition, has a horizontal bore for receiving a branch sewer pipe. An elongated pipe extends from the main sewer pipe fixture through the vertical bores in each of the sections of the sewer chimney and into the cap block. A water-tight seal is located at each end of the elongated pipe and a seal is located between each precast element of the bridge and its adjacent precast element. The invention also includes a short adapter pipe in the horizontal bore of the cap block and means for retaining the adapter pipe within the horizontal bore, and means to provide a seal between the branch sewer pipe and the cap block. The invention further includes the utilization of one or more than one elongated pipe between the main sewer pipe fixture and the cap block and a coupling for joining the adjacent ends of the pipes which maintain a water-tight seal between the adjacent ends of the pipes. This coupling acts as a guide to center the pipe within the precast sections thereby making the connecting of adjacent pipes much easier. The components of the sewer chimney are assembled in a specific manner.

BRIEF DESCRIPTION OF THE DRAWINGS

The characterization of the invention, however, may best be understood by reference to one of its structural forms, as illustrated by the accompanying drawings in which:

FIG. 1 is a perspective view of a sewer chimney embodying the principles of the present invention, FIG. 2 is a top plan view of the sewer chimney.

DETAILED DESCRIPTION OF THE INVENTION

Figure 3:
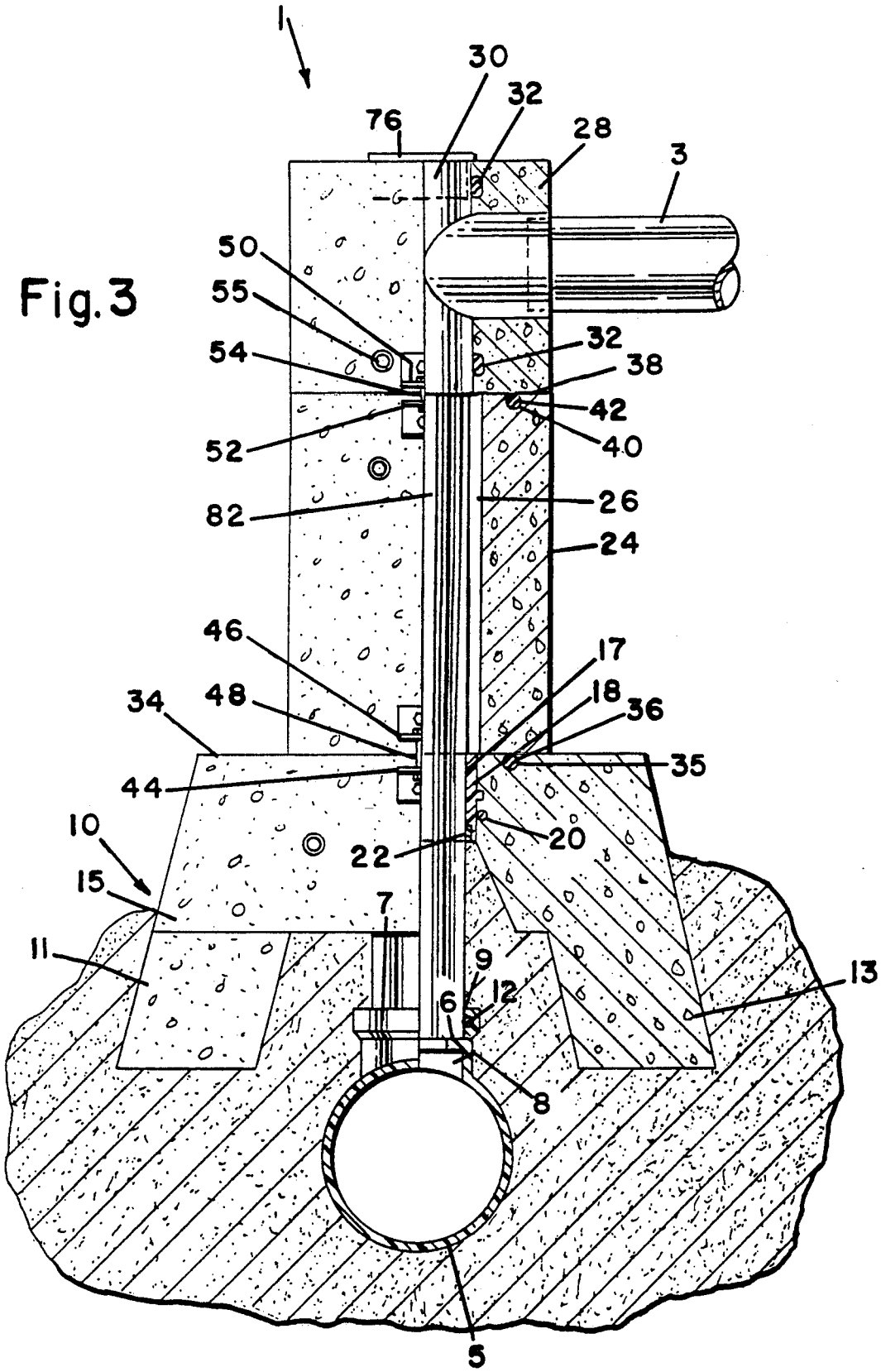
FIG. 3 is a front elevational view of the sewer chimney with portions in cross section.

Referring first to FIGS. 1-3, there is shown a sewer chimney which embodies the principles of the present invention for connecting a shallow branch sewer pipe 3 to a deeply buried main sewer pipe 5. The deeply buried main sewer pipe 5 has a fixture 7 with a vertical bore 8 which opens into an upwardly facing opening 9. The bore 8 has a gasket 12 which is adjacent the opening 9. An annular inwardly extending ridge is located at the lower end of the bore 8 which functions as a stop for a pipe which is inserted into the bore and forms part of the sewer chimney.

The sewer chimney of the present invention is generally indicated by the reference numeral 1 and comprises several precast concrete sections including a supporting base which is generally indicated by the reference numeral 10, a transitional section 24 which is supported on the base 10 and a cap block 28 which is supported on the transitional section 24. The supporting base 10 comprises a first leg portion 11, a second leg portion 13 and a bridge portion 15 which connects the two leg portions 11 and 13. The leg portions 11 and 13 are located on opposite sides of the fixture 7 and the bridge portion 15 extends above the fixture 7. The bridge portion 15 has a central tube 18 which has a vertical bore 17. The base portions 11 and 13 and the bridge portion 15 are cast as an integral unit, but may be formed as separate units which are connected together. The tube 18 is preferably made of a thermoplastic material which is incorporated into the supporting base 10 when the base is cast and is thereby a permanent part of the base. An outer gasket 20 is embedded in the bridge portion of the base between the tube 18 and the bridge 15. An inner gasket 22 is located in the bore 17 of the tube 18.

The transitional section 24 has a central vertical bore 26 which is vertically aligned with the vertical bore 17. The cap block 28 contains a "T" 30 which is preferably made of thermoplastic material, which is incorporated into the cap block when the cap block is cast. A pair of gaskets 32 are embedded in the concrete portion of the cap block between the cap block and the thermoplastic "T" 30.

The bridge portion 15 has a top surface 34 which has a circular groove 35 which contains an "O" ring 36. The transitional section 24 has a top surface 38 which has a circular groobe 40 which contains an "O" ring 42. The "O" rings 36 and 42 extend above their respective grooves so that when the transitional section 24 is placed on the surface 34, the "O" ring 36 forms a seal between the transitional section 24 and the bridge portion 15. When the cap block 28 is placed on the surface 38, the "O" ring 42 forms a seal between the transitional section 24 and the cap block 28. The front and rear face surfaces of each precast concrete section are each provided with brackets to enable the sections to be tied together by bolts. The supporting base 10 has a bracket 44 which is near the upper surface 34 and which is connected to a bracket 46 at the lower end of the transitional section 24 by a bolt 48. The lower end of the cap block 28 has a bracket 50. The upper end of the transitional section 26 has a bracket 52 which is connected to the bracket 50 by a bolt 54.

Each bracket is mounted to its corresponding concrete section by a bolt which is threaded into a threaded plastic tubular insert which is embedded into the concrete. The cap block 28 has three threaded inserts on each side of the block. One of the inserts is shown in FIG. 3 and indicated by the reference numeral 55. This enables the cap block to assume three different angular positions relative to the transitional section 24.

Figure 5:
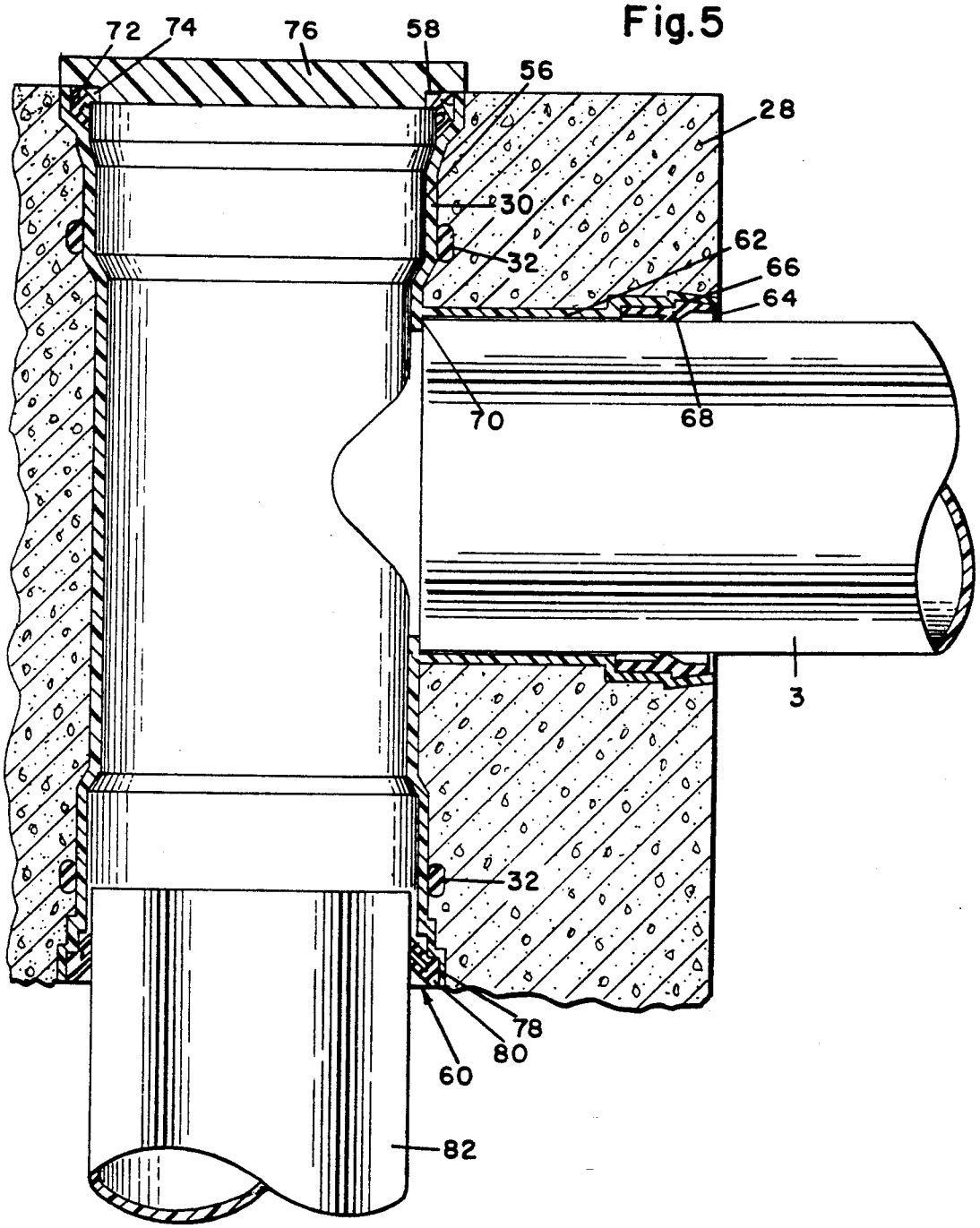
FIG. 5 is a vertical cross-sectional view of the cap block portion of the sewer chimney for holding a relatively large diameter branch sewer pipe.

Referring particularly to FIG. 5, the "T" 30 has a vertical bore 56 which is vertically aligned with the vertical bores 26 and 17 of the transitional section 24 and the bridge portion 15, respectively. The "T" 30 has a horizontal bore 62 which extends laterally from the bore 56 to an outer opening 64. The bore 62 has an annular groove 66 which is adjacent the outer opening 64 and which contains a gasket 68. The vertical bore 56 has a top opening 58 and a bottom opening 60. The bore 56 has an annular groove 72 adjacent the upper opening 58 and an annular groove 78 adjacent the bottom opening 60. A gasket 74 is located in the annular groove 72 and a gasket 80 is located in the annular groove 78. The top opening 58 is closed by a cap 76 which engages the gasket 74 to form a water-tight seal at the upper end of the sewer chimney.

If the bracket 50 is mounted to the middle insert 55, the horizontal bore 62 extends at a right angle to the main sewer line 5. The other two inserts enable the cap block to be positioned on the transitional section 24 a predetermined number of degrees on either side of a line which is normal to the longitudinal axis of the main sewer line 5. This feature provides flexibility to the sewer chimney when connecting the sewer chimney to a branch sewer pipe.

Referring particularly to FIGS. 3 and 5, an elongated pipe 82 extends from the fixture 7 of the main sewer line through the vertical bores 17 and 26 and into the vertical bore 56 to a point below the horizontal bore 62. The gasket 12 provides a static seal between the bore 8 and the elongated pipe 82. The gasket 78 provides a slidable static and dynamic seal between the pipe 82 and the vertical bore 56. This allows for relative movement between the elongated pipe 82 and the cap block 28. This relative movement is likely to occur during settling of the sewer chimney structure after installation. This relative movement also insures that stresses do not develop in the structure between the sewer chimney structure and the main sewer line while sealing integrity is maintained between the elongated pipe 82 and the cap block 28. The length of the elongated pipe 82 varies in accordance to the height of the intermediate or transitional section 24. The seals between the concrete sections of the chimney and the seals which are associated with the elongated pipe 82 provide a double seal condition so as to prevent any possible infiltration or exfiltration of liquids. An annular ridge 70 is located between the vertical bore 56 and the horizontal bore 62. The ridge 70 functions as a stop to prevent the branch sewer pipe 3 from entering the vertical bore 56.

Figure 6:
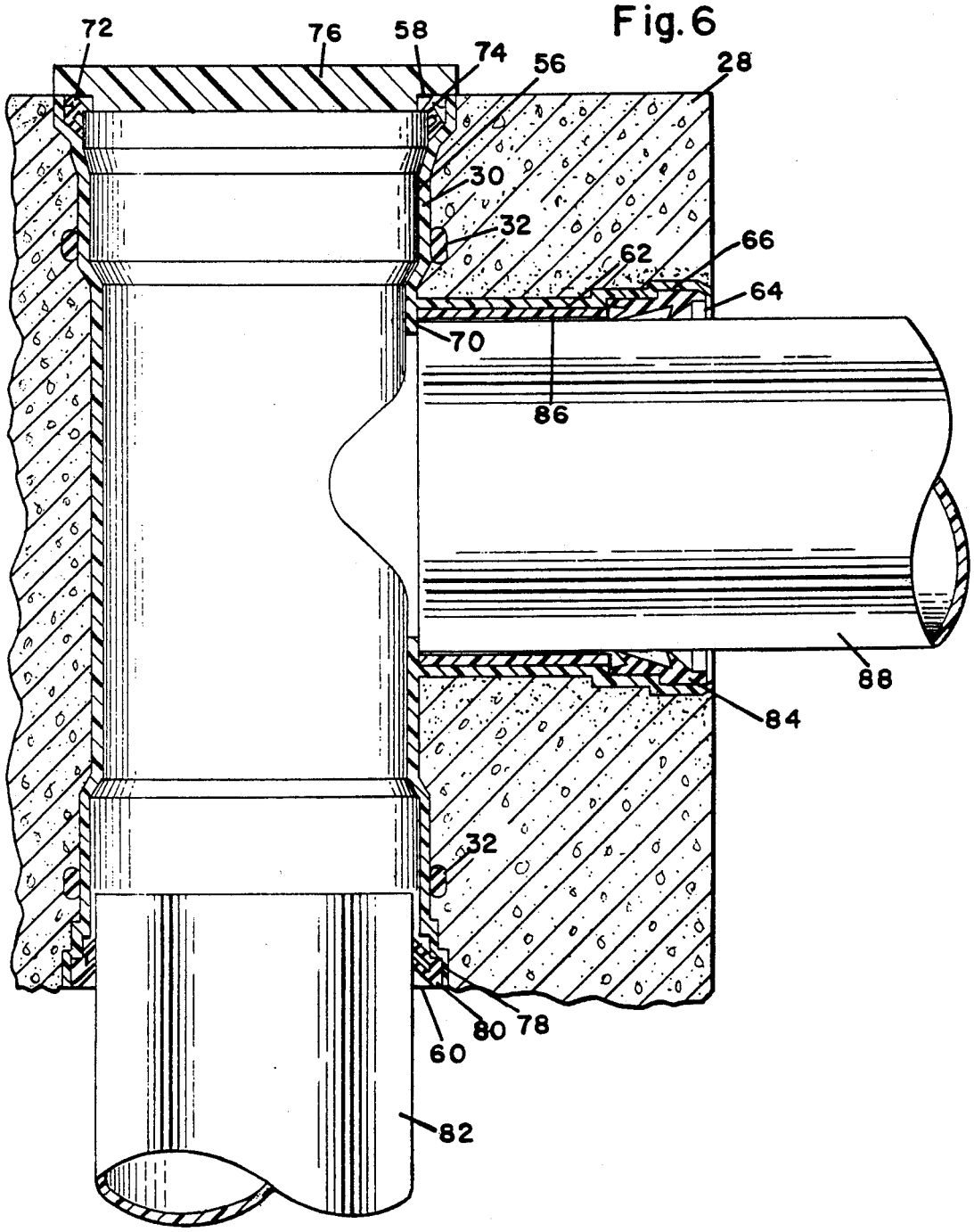
FIG. 6 is a view similar to FIG. 5 showing an adapter for enabling the cap block to hold a relatively small diameter branch sewer pipe.

Referring particularly to FIGS. 5 and 6, the service pipe 3 is a relatively large outside diameter pipe which fits comfortably within the horizontal bore 62 with sufficient clearance to enable the pipe to be inserted relatively easily into the bore. When a relatively small outside diameter service pipe 88 is utilized, a short adapter tube 86 is inserted into the bore 62 prior to the application of a sealing gasket 84 into the annular groove 66 so that the adapter tube 86 is trapped between the ridge 70 and the gasket 84 as shown in FIG. 6. The gasket 84 is relatively larger than the gasket 68 which is utilized with the service pipe 3. The ridge 70 extends inwardly to a sufficient degree so that a continuous function as a stop to prevent the inner end of the service pipe 88 from entering the vertical bore 56. The gasket 84 provides a water-tight seal between the branch sewer pipe 88 and the "T" 30 of the cap block 28.

Figure 4:
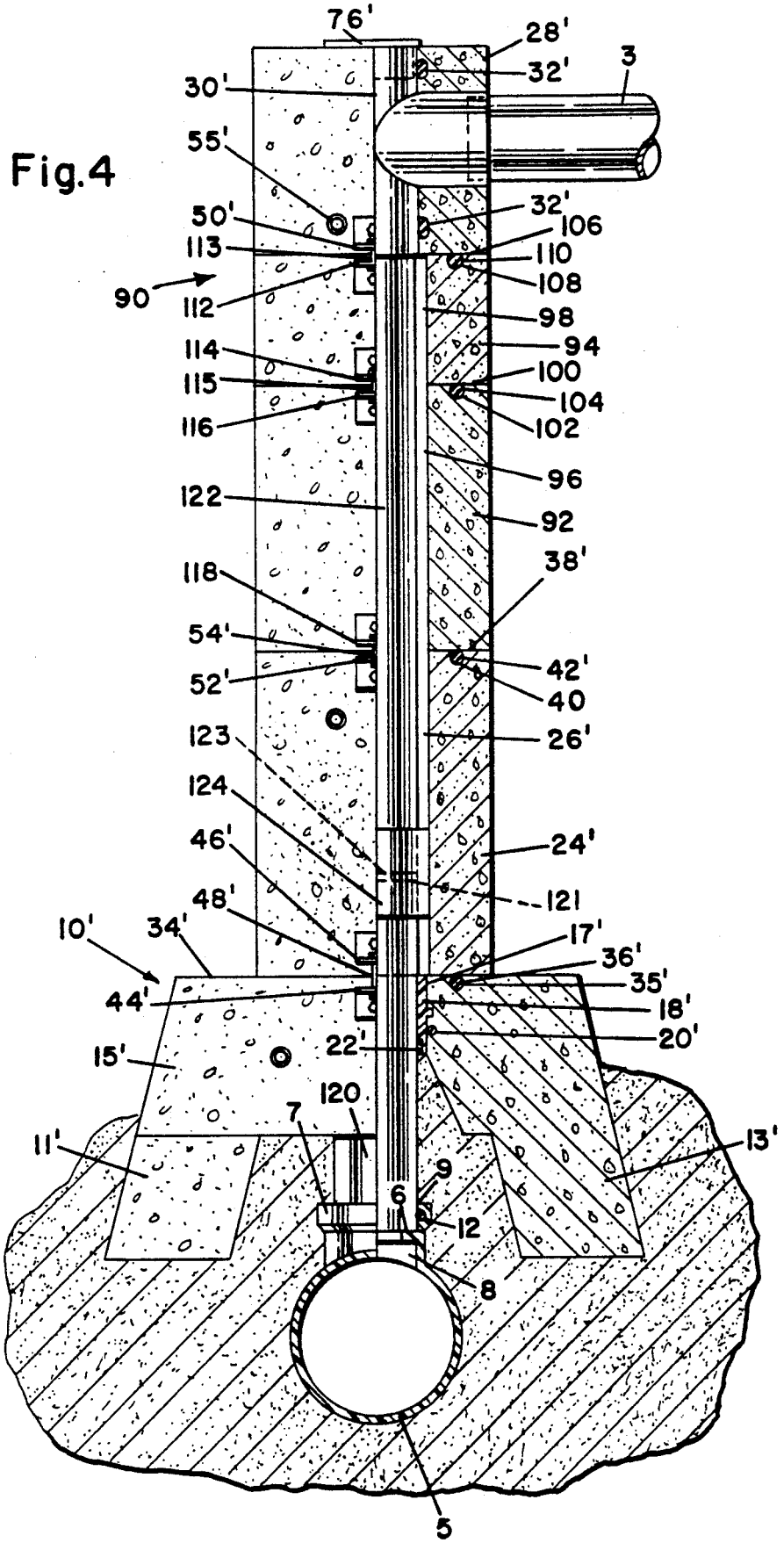
FIG. 4 is a view similar to FIG. 3 showing a modification for relatively tall chimneys.

Referring to FIG. 4, there is shown a modified sewer chimney of the present invention which is generally indicated by the reference numeral 90. The sewer chimney 90 is a relatively tall sewer chimney for connecting the branch sewer pipe 3 to the main sewer pipe 5 wherein the main sewer pipe 5 is located at a considerably greater depth than for the application which is illustrated in FIG. 3. The modified sewer chimney 90 includes a supporting base 10' which is identical to the supporting base 10 and includes first and second leg portions 11' and 13', respectively and a bridge portion 15'. The bridge portion 15' includes a central plastic tube 18' which has a vertical bore 17'. The sewer chimney 90 also includes a cap block 28' which is identical to the cap block 28 so that all elements of the cap block 28' have the same reference numeral as the corresponding elements of the cap block 28 with the addition of a prime after each numeral. The cap block 28' is located at a considerably higher distance from its supporting base than the cap block 28 is from its supporting base. Because of this greater distance, several transitional precast concrete sections are utilized. The first transitional section is identified by the reference numeral 24' and is identical to the transitional section 24. All the elements of section 24' are identified by the same reference numeral as for the section 24 with the addition of a prime after each numeral. In the example shown in FIG. 4, two additional transitional sections are utilized, sections 92 and 94. The number and size of the transitional sections which extend between the cap block and the supporting base depends on the distance between these two elements. In the example shown in FIG. 4, the transitional section 92 has an upper surface 100 which has a groove 102 that contains an "O" ring 104 for forming a seal between the sections 92 and 94. The transitional section 94 has an upper surface 106 which has a circular groove 108 which contains an "O" ring 110 for forming a water-tight seal between the section 94 and the cap block 28'. The transitional section 92 has a vertical bore 96 which is vertically aligned with the vertical bore 26' and the vertical bore 17'. The transitional section 94 has a vertical bore 98 which is vertically aligned with the bores 96, 26' and 17'. The lower portion of the section 92 has a bracket 118 which is connected to the bracket 52' of the section 24' by the bolt 54'. The upper end of the section 92 has a bracket 116 which is connected to a bracket 114 of the transitional section 94 by a bolt 114. The upper end of the transitional section 94 has a bracket 112 which is connected to the bracket 50' by a bolt 113. The brackets and connecting bolts for the sections of the sewer chimney are illustrated in FIG. 4 on the front face of the sewer chimney. The rear face of the sewer chimney (not shown) has an identical pattern of brackets and bolts. The embodiment of FIG. 4 includes two vertical connecting pipes, a lower pipe 120 and an upper pipe 122. The lower end of the pipe 120 is located in the fixture 7 of the main sewer pipe. The upper end of the pipe 122 is located in the "T" 30'. The upper end of the pipe 120 is identified by the reference numeral 121 and extends above the surface 34' of the bridge portion 15'. The bottom end of the pipe 122 is identified by the reference numeral 123 and is located just above the upper end 121 of the pipe 120. The upper end 121 of the pipe 120 is connected to the lower end 123 of the pipe 122 by a coupling 124.

Figure 7:
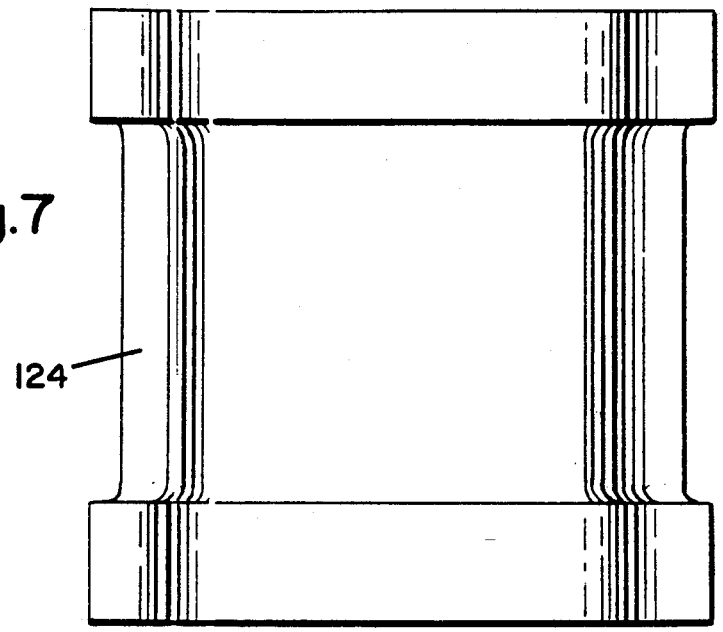
FIG. 7 is an elevational view of a coupling for the embodiment shown in FIG. 4 which is used to join two lengths of pipe within the sewer chimney.
Figure 8:
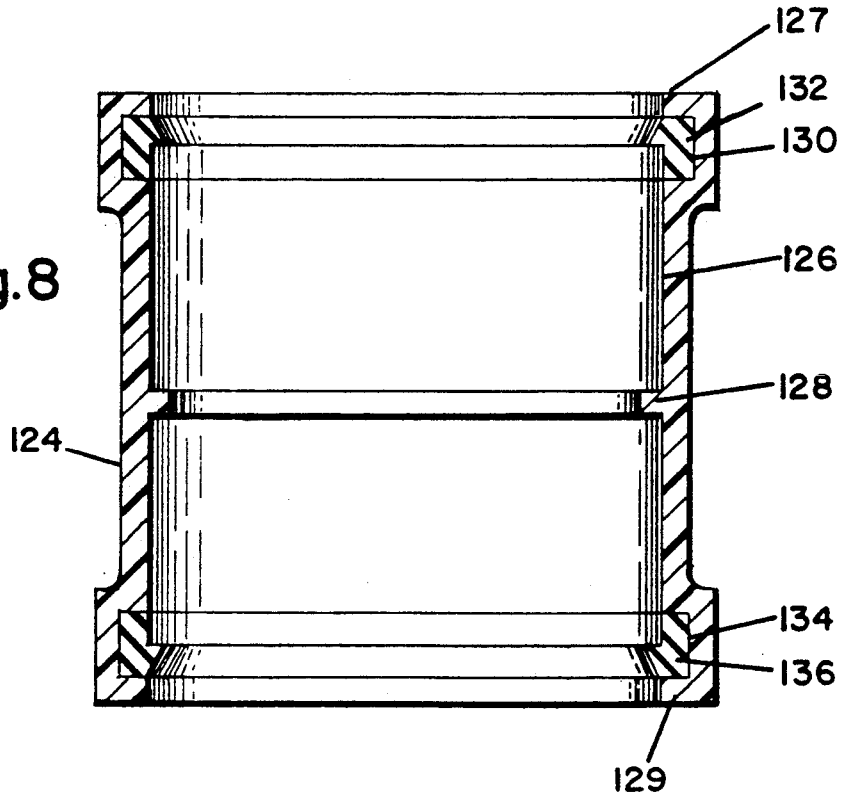
FIG. 8 is a vertical cross-sectional view of the coupling.

Referring to FIGS. 4, 7 and 8, the coupling 124 has a vertical bore 126 which has a top opening 127 and a bottom opening 129. The bore 126 has an upper annular groove 130 which is adjacent the top opening 127 and which contains a gasket 132. The bottom end of the bore 126 has an annular groove 134 which is adjacent the bottom opening 129 and which contains a gasket 136. The bore 126 has a central annular inwardly extending ridge 128 which functions as a stop for the upper end 121 of the pipe 120 and the lower end 123 of the pipe 122. The gaskets 132 and 136 provide a water-tight seal between the pipes 120 and 122 and the coupling 124. If the distance between the main sewer pipe 5 and the branch sewer pipe 3 is greater than that which is shown in FIG. 4, additional transitional sections are utilized as well as additional connecting pipes between the branch sewer pipe and the main sewer pipe. Each additional connecting pipe is connected to an adjacent pipe by a coupling 124.

Figure 9:
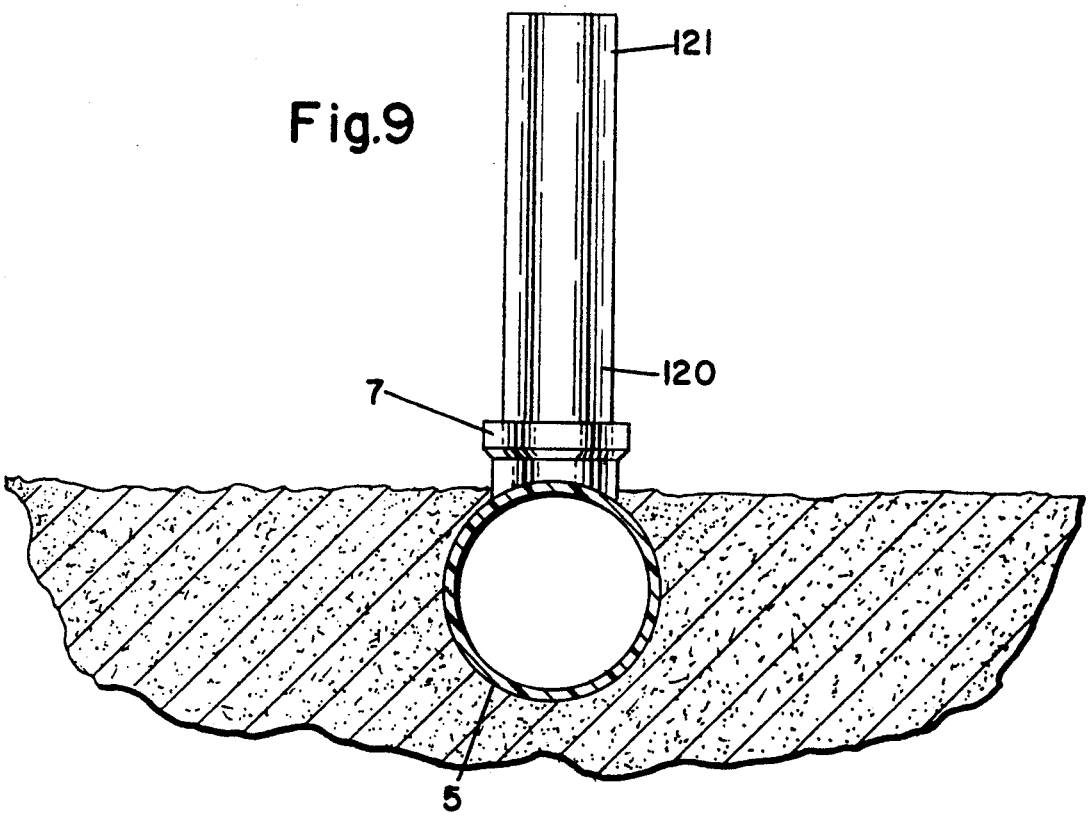
FIGS. 9-15 illustrate steps in the method of constructing the sewer chimney embodiment which is shown in FIG. 4.
Figure 10:
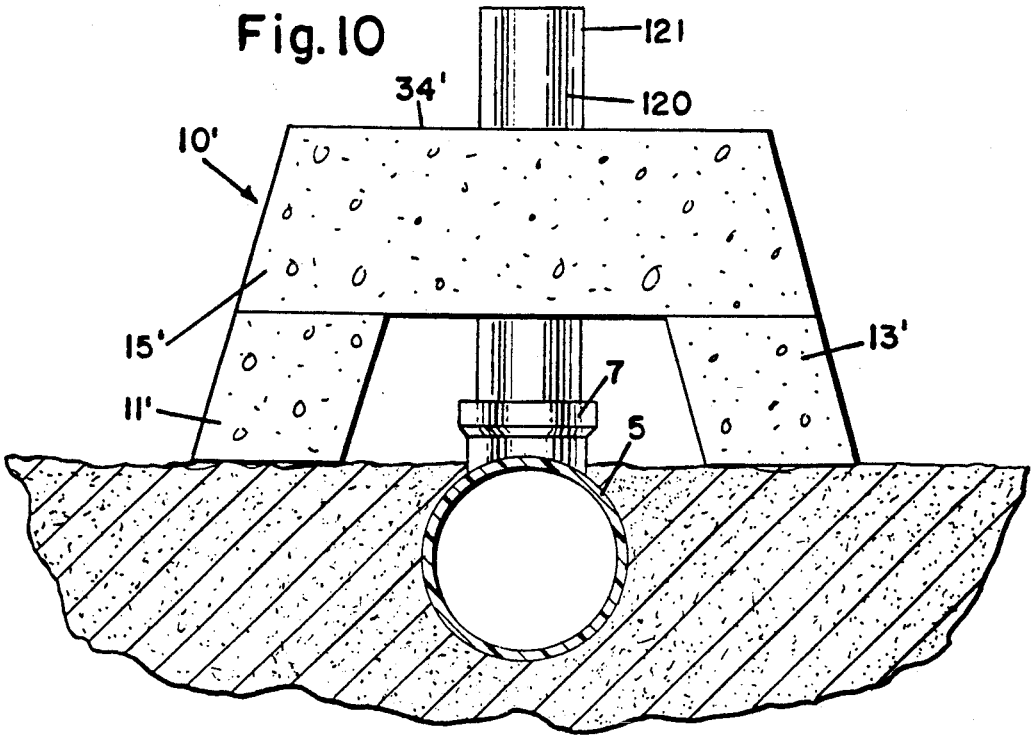
Figure 11:
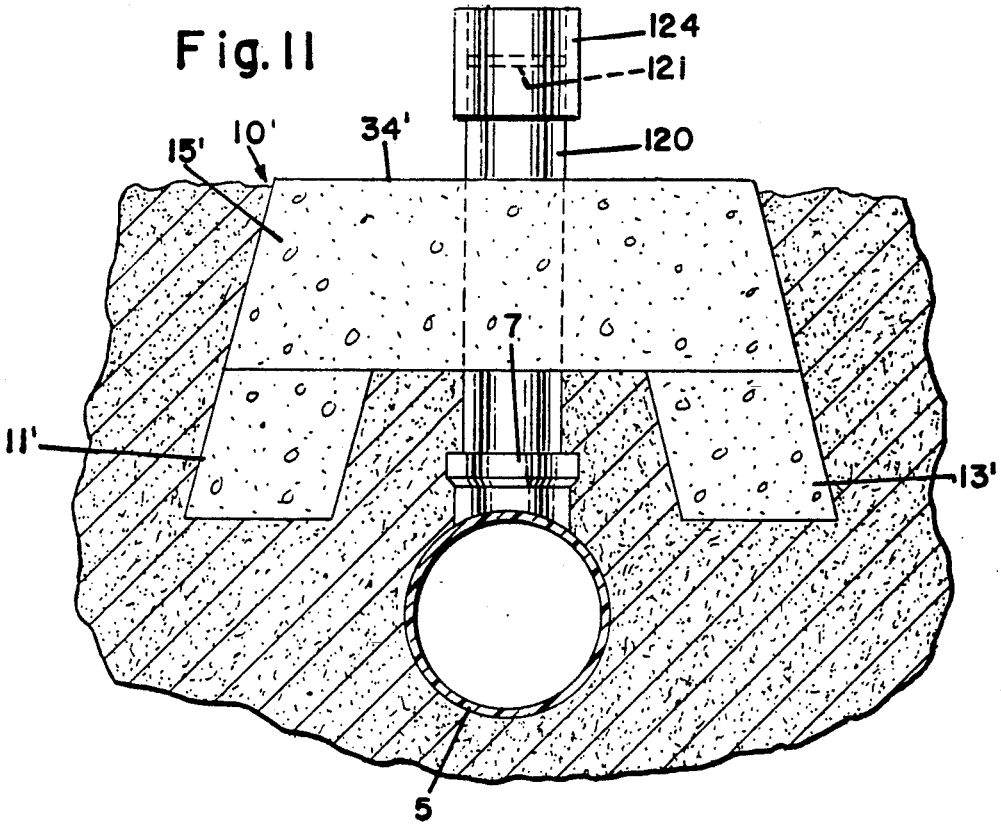
Figure 12:
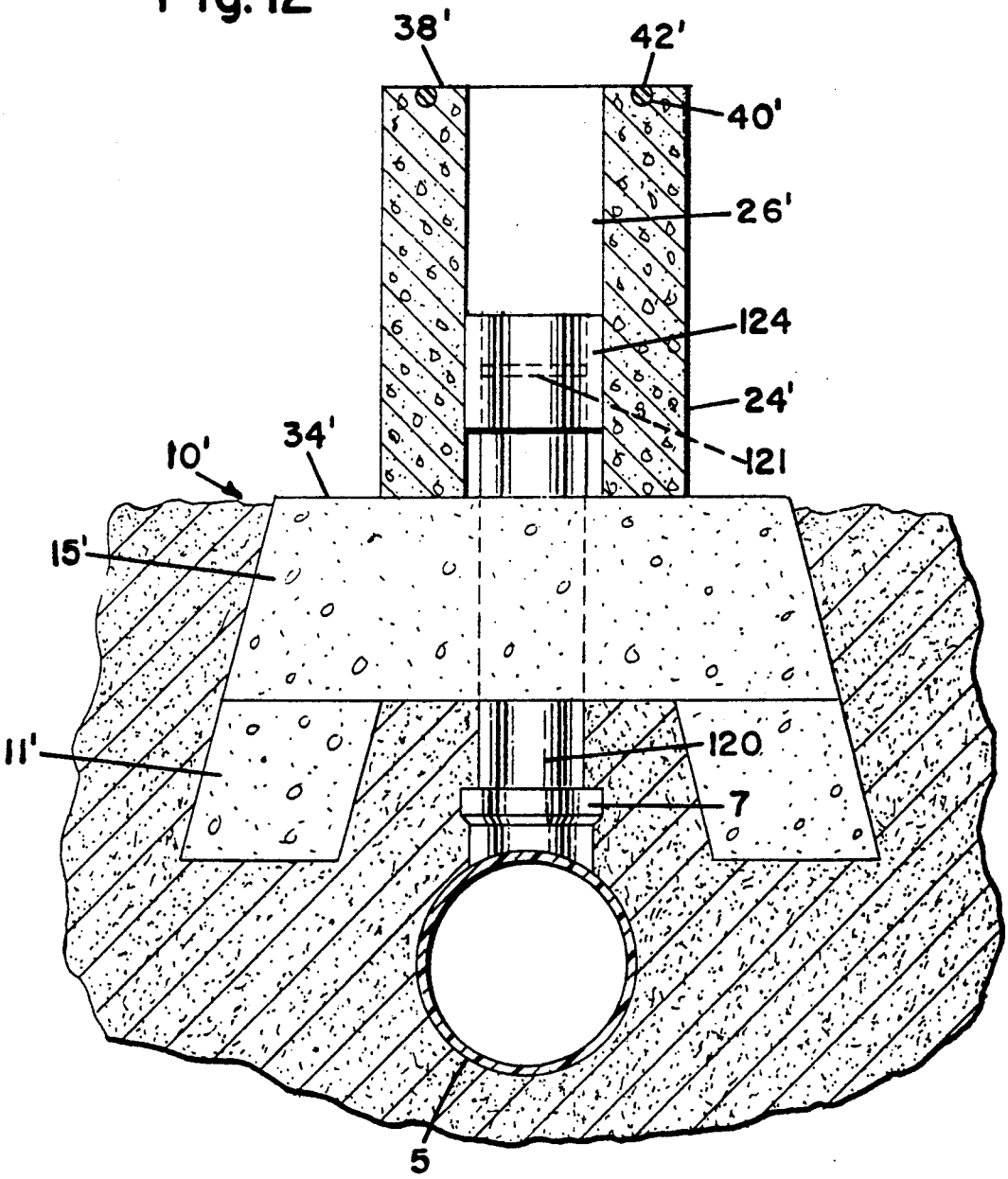

Referring to FIGS. 9–15, the installation and operation of the invention will now be readily understood in view of the above description. FIGS. 9–15 illustrate the construction of the embodiment 90 which is shown in FIG. 4. At the beginning of the construction, the installer inspects all parts of the prefabricated sewer chimney for any shipping damage. The work on the sewer chimney can begin as soon as the excavation has been complete. The pipe 120 is inserted into the fixture 7 down to the stop 6 and the upper end of the pipe is temporarily covered by a temporary cap to prevent backfill material from getting into the sewer. The trench in which the sewer chimney is being constructed is filled with appropriately screened gravel. The gravel is level and compacted to a specific height below the top of the fixture 7 as shown in FIG. 9. The temporary cap on the pipe is removed. The supporting base 10′ is then lowered into the trench over the vertical pipe 120 so that the pipe extends upwardly through the bore 17′ of the bridge 15′ and the base legs 11′ and 13′ rest on the gravel on opposite sides of the fixture 7 as shown in FIG. 10. The entire area under the bridge 15′ is filled and compacted with sand and the balance of the area around the bridge is filled with gravel to a level that is even with the top of the bridge. The coupling 124 is then applied to the upper end 121 of the pipe 120 as shown in FIG. 11.

Figure 13:
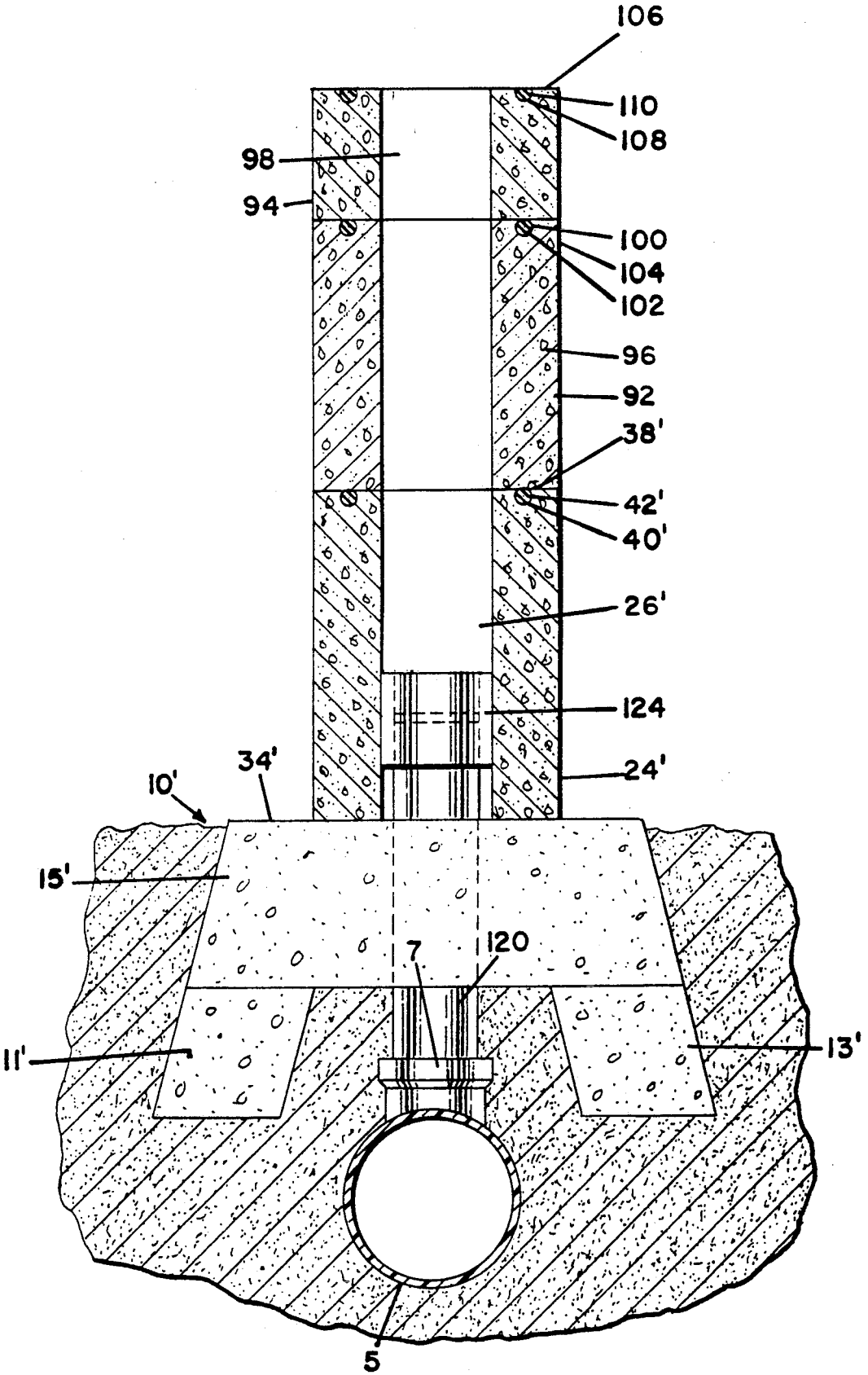

The transitional section 24′ is lowered into the trench over the vertical pipe 120 so that the upper end of the pipe and the coupling 124 extend into the bore 26′ and so that the transitional section 24′ rests on the upper surface 34′ of the bridge. The transitional section 24′ is then bolted to the bridge portion 15′ by means of the brackets 44′ and 46′. The additional two transitional sections 92 and 94 are then added to the structure as shown in FIG. 13. Prior to the addition of each transitional section, care is utilized to make sure that the bottom and top surfaces of the sections are clean and free of dirt so that as each "O" ring is inserted into its appropriate circular groove at the top of one section it forms a water-tight seal between that section and the adjacent section above. As each transitional section is added, it is bolted to the previous section by means of the brackets which extend from each section.

Figure 14:
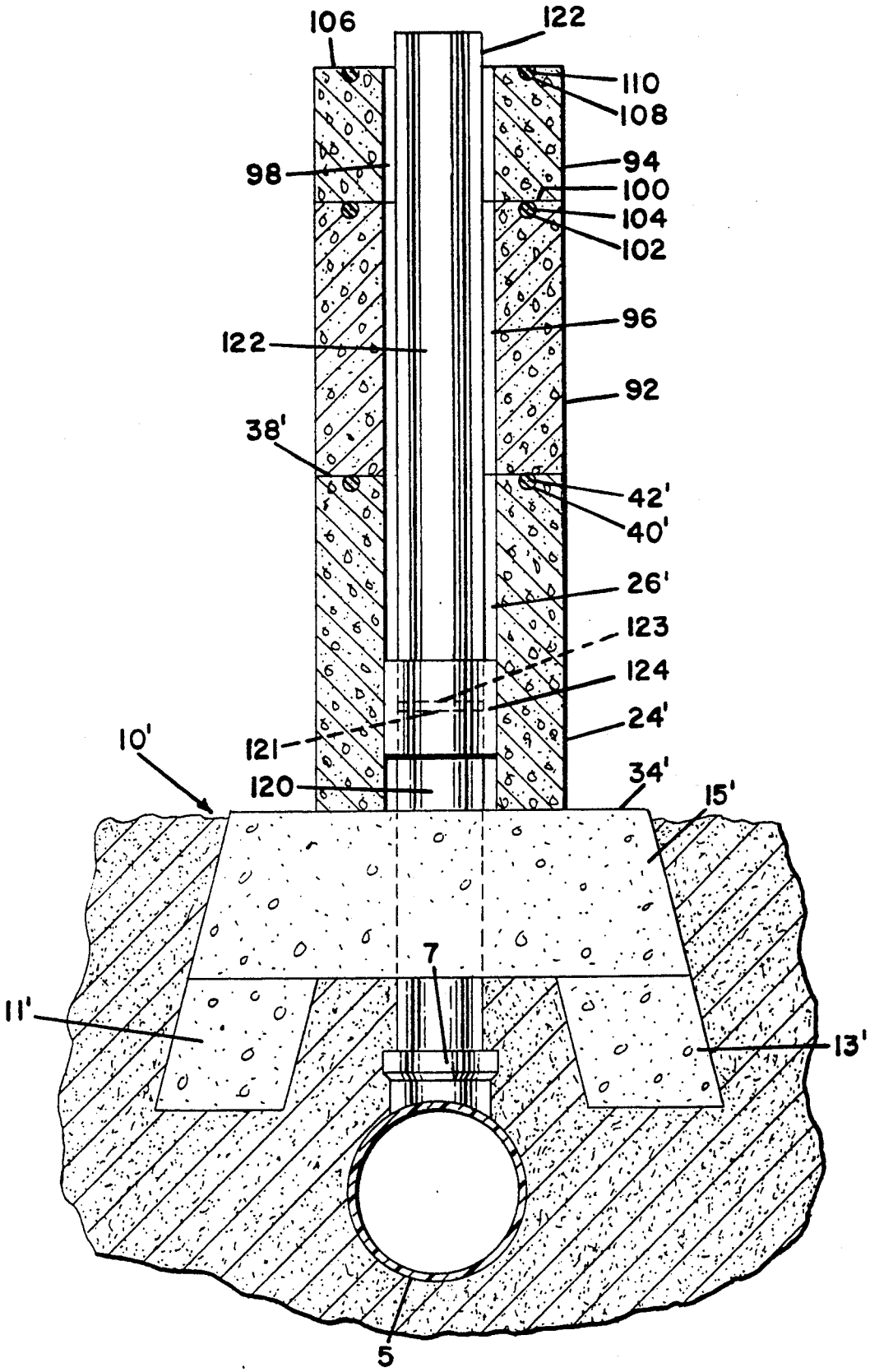
Figure 15:
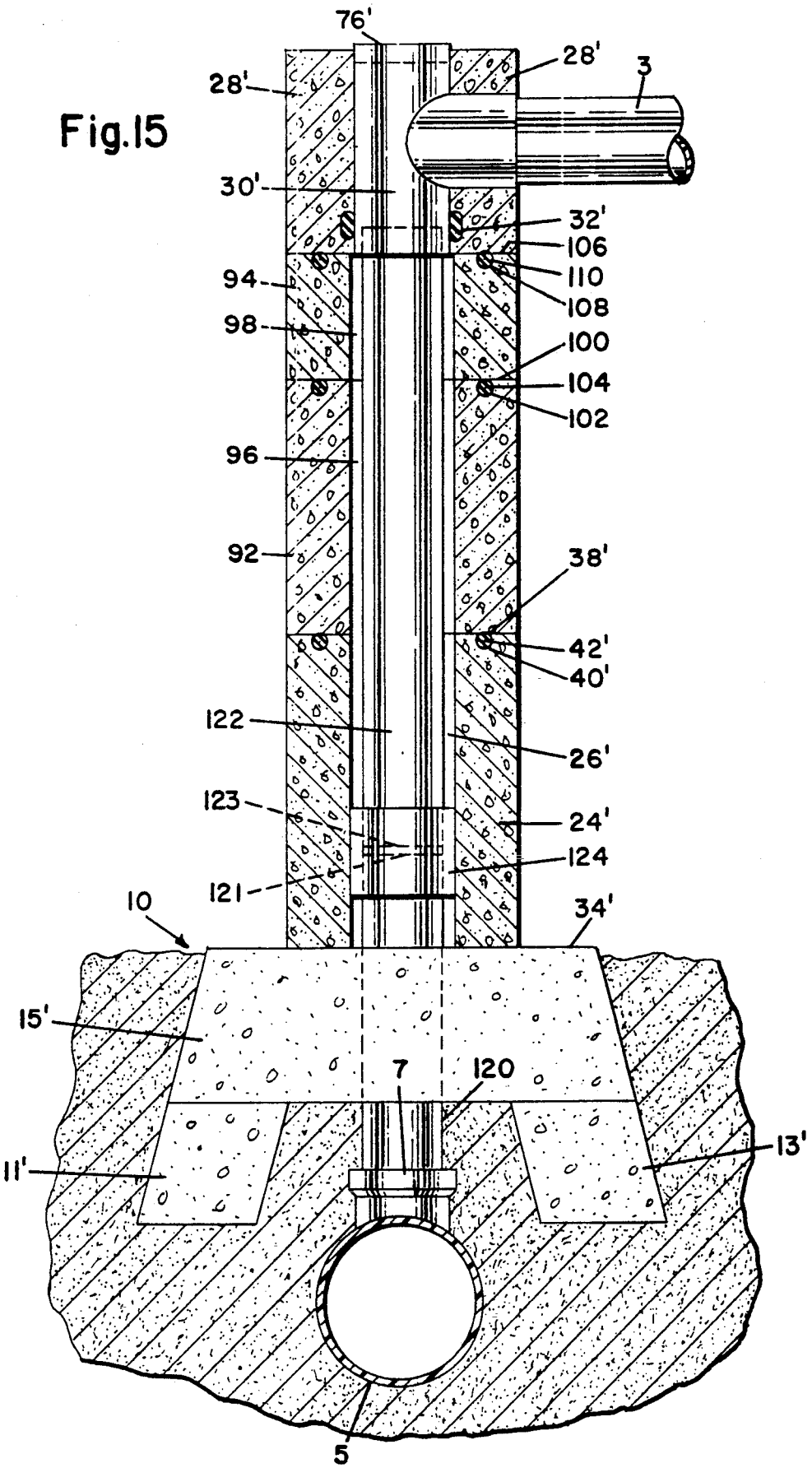

After all of the transitional sections have been added to the structure and tied together, the second pipe 122 is inserted into the coupling 124 so that the bottom end of the pipe extends into the coupling and the top end of the pipe extends to a point above the uppermost transitional section 94 as shown in FIG. 14. Water is placed in the bores 98, 96 and 26. This fills the void between the interior pipe and bore. As soon as this cap block is placed and drawn down, the water is pressurized and the unit is automatically tested. If the pipe seals are defective, the water will shoot inside. If the intermediate seals are leaking, the water will flow to the exterior. If the bottom bridge seal is leaking, the water will go down. If there is a major leak, it will be noticeable before placing the cap as the water will drop in elevation immediately, or the installer will not be able to fill the void fast enough to get the water to the top. The cap block 28′ is then mounted onto the transitional section 94 so that the top end of the pipe 122 extends into the vertical bore of the "T" 30′ at a point below the horizontal bore of the "T" as shown in FIG. 15. The service sewer pipe 3 is then inserted into the horizontal bore of the "T" 30′ as shown in FIG. 15. The cap block 28′ is bolted to the upper transitional section 94 and the top opening of the horizontal bore of the "T" 30′ is closed by the cap 76′.

The short sewer chimney which is shown in FIG. 3 is constructed by first inserting the single elongated pipe 82 into the main sewer line fixture 7 and then adding the supporting base 10, transitional section 24 and cap block 28 in succession so that the pipe 82 extends through the vertical bores 17 and 26 and into the bore 56 of the cap block. The transitional section 24 is bolted to the supporting base 10 and the cap block 28 is bolted to the transitional section 24. The lateral service pipe 3 is inserted into the horizontal bore of the "T" 30. The top opening of the vertical bore 56 is sealed by the cap 76.

Clearly, minor changes may be made in the form and construction of this invention and in the embodiments of the process without departing from the material spirit of either. Therefore, it is not desired to confine the invention to the exact forms shown herein and described, but it is desired to include all subject matter that properly comes within the scope claimed.

The invention having been thus described, what is claimed as new and desired to secure by Letters Patent is:

1. A sewer chimney for connecting a surface branch sewer pipe to a deeply buried main sewer pipe having a fixture with an upwardly facing opening, said sewer chimney comprising:

(a) a base which has first and second leg portions which are positioned on opposite sides of the main sewer line and a bridge portion which extends from said first leg portion to said second leg portion and passes over the main sewer line, said bridge portion having a first vertical bore which is vertically aligned with said upwardly facing opening, (b) a transitional section which rests on and is secured to said bridge portion, said transitional section having a second vertical bore which is vertically aligned with said first vertical bore, (c) a cap block which rests on and is secured to the transitional section, said cap block having a third vertical bore which is vertically aligned with said first and second vertical bores, said cap block having a horizontal bore which intersects said third vertical bore, said horizontal bore having an outer opening which is adapted to receive a branch sewer pipe, (d) an elongated pipe which extends from said first vertical bore, through said second bore and into said third vertical bore, (e) a first seal between said transitional section and said bridge portion, (f) a second seal between said transitional section and said cap block, (g) a third seal between said pipe and said bridge portion, (h) a fourth seal between said pipe and said cap block, and (i) a fifth seal between said pipe and the fixture of said main sewer pipe.

2. A sewer chimney as recited in claim 1, wherein said elongated pipe comprises at least two individual pipe sections which are connected together by a coupling.

3. A sewer chimney as recited in claim 2, wherein each pipe section has a free end which faces the free end of an adjacent pipe section and wherein said coupling comprises:

(a) a sleeve which is coaxial with said bore, said sleeve having a first opening at one end for receiving a free end of one of said pipe sections and a second opening at the opposite end for receiving a free end of an adjacent pipe section, (b) a first coupling seal between said sleeve and one of said pipe sections, and (c) a second coupling seal between said sleeve and an adjacent pipe 4. A sewer chimney as recited in claim 3, wherein there is a stop in the interior of said sleeve for positioning the free ends of two adjacent pipe sections.

5. A sewer chimney as recited in claim 4, wherein said sleeve has an inner cylindrical surface and said stop is an annular ridge which extends inwardly from said inner surface.

6. A sewer chimney as recited in claim 1, wherein each of said third, fourth and fifth seals is a gasket which extends around and engages the outer surface of said elongated pipe to permit vertical adjustment of said pipe relative to said base, said transitional section and said cap block.

7. A sewer chimney for connecting a surface branch sewer pipe to a deeply buried main sewer pipe having a fixture with an upwardly facing opening, said sewer chimney comprising:

(a) a base which has first and second leg portions which are positioned on opposite sides of the main sewer line and a bridge portion which extends from said first leg portion to said second leg portion and passes over the main sewer line, said bridge portion having a first vertical bore which is vertically aligned with said upwardly facing opening, (b) a transitional section which rests on and is secured to said bridge portion, said transitional section having a second vertical bore which is vertically aligned with said first vertical bore, (c) a cap block which rests on and is secured to said transitional section, said cap block having a third vertical bore which is vertically aligned with said first and second vertical bores, said cap block having a horizontal bore which intersects said third vertical bore, said horizontal bore having an outer opening which is adapted to receive a branch sewer pipe, said horizontal bore being defined by a cylindrical inner surface, said inner surface having an annular groove adjacent said outer facing opening, (d) a cylindrical adapter which lies in said horizontal bore between said third vertical bore and said annular groove, said adapter having an outer cylindrical surface which abuts the cylindrical inner surface of said horizontal bore, said adapter having a cylindrical inner surface which effectively reduces the inner diameter of said horizontal bore, (e) a stop between said third vertical bore and said cylindrical adapter for maintaining said adapter outside of said third vertical bore, (f) a gasket which is located in said annular groove, said gasket having an inside diameter which is less than the diameter of the cylindrical inner surface of said adapter for preventing said adapter from moving to said outer facing opening and for providing a seal between said cap block and a pipe which is inserted into said adapter, and (g) an elongated pipe which extends from said first vertical bore, through said second bore and into said third vertical bore.

8. A sewer chimney for connecting a surface branch sewer pipe to a deeply buried main sewer pipe having a fixture with an upwardly facing opening, said sewer chimney comprising:

(a) a base which has first and second leg portions which are positioned on opposite sides of the main sewer line and a bridge portion which extends from said first leg portion to said second leg portion and passes over the main sewer line, said bridge portion having a first vertical bore which is vertically aligned with said upwardly facing opening, (b) a transitional section which rests on and is secured to the bridge, said transitional section having a second vertical bore which is vertically aligned with said first vertical bore, (c) a cap block which rests on and is secured to the transitional section, said cap block having a third vertical bore which is vertically aligned with said first and second vertical bores, said cap block having a horizontal bore which intersects said third vertical bore, said horizontal bore having an outer opening which is adapted to receive a branch sewer pipe, (d) a first vertical pipe which extends upwardly from a lower end in the fixture of said main sewer pipe to an upper end above said bridge portion, (e) a second pipe which extends upwardly from a lower end which is adjacent the upper end of said first pipe to an upper end which is located in said cap block, (f) a coupling for operatively coupling the upper end of said first pipe to the lower end of said second pipe in a sealing relationship, (g) a first seal between said first pipe and said bridge portion, and (h) a second seal between said second pipe and said cap block.

9. A sewer chimney as recited in claim 8, wherein each of said first and second seals is a gasket between the corresponding pipe and corresponding bridge portion and cap block.

10. A sewer chimney as recited in claim 8, wherein each pipe section has a free end which faces the free end of an adjacent pipe section and wherein said coupling comprises:

(a) a sleeve which is coaxial with said bore, said sleeve having a first opening at one end for receiving a free end of one of said pipe sections and a second opening at the opposite end for receiving a free end of an adjacent pipe section, (b) a first coupling seal between said sleeve and one of said pipe sections, and (c) a second coupling seal between said sleeve and an adjacent pipe section.

* * * * *